United States Patent [19]

Cannell

[11] Patent Number: 5,025,358

[45] Date of Patent: Jun. 18, 1991

[54] DUST RESISTANT ELECTRIC LIGHT FIXTURE

[75] Inventor: Timothy A. Cannell, Kirkwood, Mo.

[73] Assignee: Guth Lighting Inc., St. Louis, Mo.

[21] Appl. No.: 525,916

[22] Filed: May 18, 1990

[51] Int. Cl.[5] ..... F21V 29/00

[52] U.S. Cl. ..... 362/267; 362/310; 362/344

[58] Field of Search ..... 362/267, 344, 359, 376, 362/310, 311

[56] References Cited

U.S. PATENT DOCUMENTS 3,840,734 10/1974 Orhm ..... 362/267

*Primary Examiner*—Carroll B. Dority

*Attorney, Agent, or Firm*—Pasquale A. Razzano

[57] ABSTRACT

An electric light fixture is disclosed which includes a lamp head housing, a lamp or bulb within the housing and an elliptical reflector for focusing light from the lamp to a predetermined focal point. A transparent lens is positioned across the open end of the housing and and extension ring is removably mounted on that open end of the housing and extends away from the housing and the lens. This ring creates an air space beneath the lens within the confines of the ring that traps heat generated from the bulg and reflected to a position within the ring whereby dust particles are deflected away from the lens by convection air flow created as a result of the heat trapped in such space.

6 Claims, 2 Drawing Sheets

DUST RESISTANT ELECTRIC LIGHT FIXTURE

Figure 1:
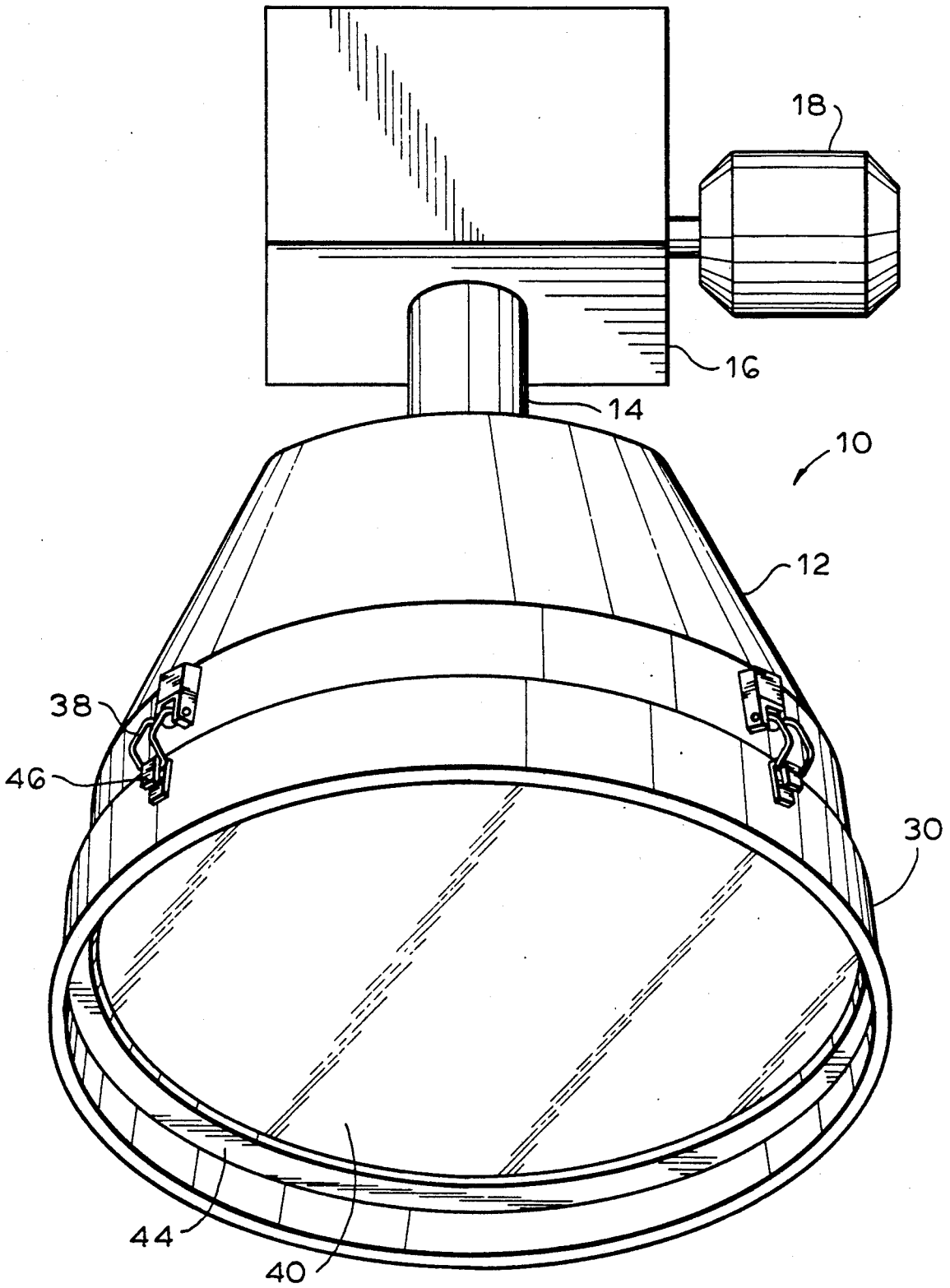

The present invention relates to electrical lighting fixtures, and more particularly to a lighting fixture creating a high intensity light in a dust-filled environment.

BACKGROUND OF THE INVENTION

In many work environments, particularly in factories, warehouses and the like, very large spaces are provided which must be lit by large overhead lighting systems. In such spaces, particularly in factories or foundries, there is substantial airborne dirt and dust which will rise to the ceilings of the building and accumulate on the overhead light fixtures. This necessitates periodic cleaning of the fixtures, which is often difficult to do because they are mounted in very high ceilings so that access to them is difficult.

In addition, because large overhead industrial light fixtures create a large amount of heat there must be a means to remove the heat from the fixture so that it does not damage the thermally vulnerable electrical components in the ballast. For this reason most industrial fixtures use open reflectors which allow circulating air to keep all components cool. The open reflector arrangement itself serves to draw dirt and dust particles towards the light fixture and increases the possibility of dust and dirt accumulating on the light fixture.

In some industrial light fixtures, the reflector is sealed with the intent of excluding dust and dirt from the interior of the fixture. Normally a lens is provided over the bottom of the reflector. This arrangement may keep the interior of the lens clean but there is no mechanism for keeping the exterior of the lens clean.

In some sealed units a ring is provided around the exterior of the lens to provide a barrier to circulating dust and dirt. This works to reduce the amount of airborne dust and dirt circulating near the lens but does not provide a mechanism for insuring that this dust and dirt falls away from the lens without contacting it.

It is an object of the present invention to provide a light fixture which will resist the accumulation of dirt and dust on the exterior of the lens thereof.

Another object of the present invention is to provide a high intensity light fixture which will resist the accumulation of dirt and dust on its light diffusing lens.

Yet another object of the present invention is to provide a light fixture of the character described which is relatively inexpensive to manufacture and simple to assemble.

A further object of the present invention is to provide a light fixture of the character described which is relatively simple to disassemble for cleaning when necessary.

In accordance with an aspect of the present invention, an electrical light fixture is provided which includes a lamp head having an open end that defines a peripheral edge. A light bulb, such as a high intensity discharge bulb, is mounted within the housing for distributing light through the open end thereof. A reflector is mounted in the housing for reflecting light produced by the bulb through the open end of the housing. The reflector has a generally elliptical shape in cross section and is positioned relative to the bulb to focus light from the bulb at a predetermined focal point. This produces a high intensity light as well as substantial heat in the area of that focal point.

A transparent lens is mounted on the housing adjacent the peripheral edge thereof and means are provided for creating a dust seal between the lens and the housing to prevent dust from entering into the housing and accumulating on the reflector or the light bulb. An extension ring is removably mounted on the open end of the lamp housing, with the ring extending away from the housing and the lens therein. This defines an airspace adjacent the lens and within the ring. A layer of warm air heated by the bulb will thus form and it is trapped within the ring due to convection. This warm air layer forms a barrier to dust particles approaching the light fixture and will cause dust particles to fall away from the lens due to gravity. Thus, accumulation of dust on the lens is reduced.

Figure 2:
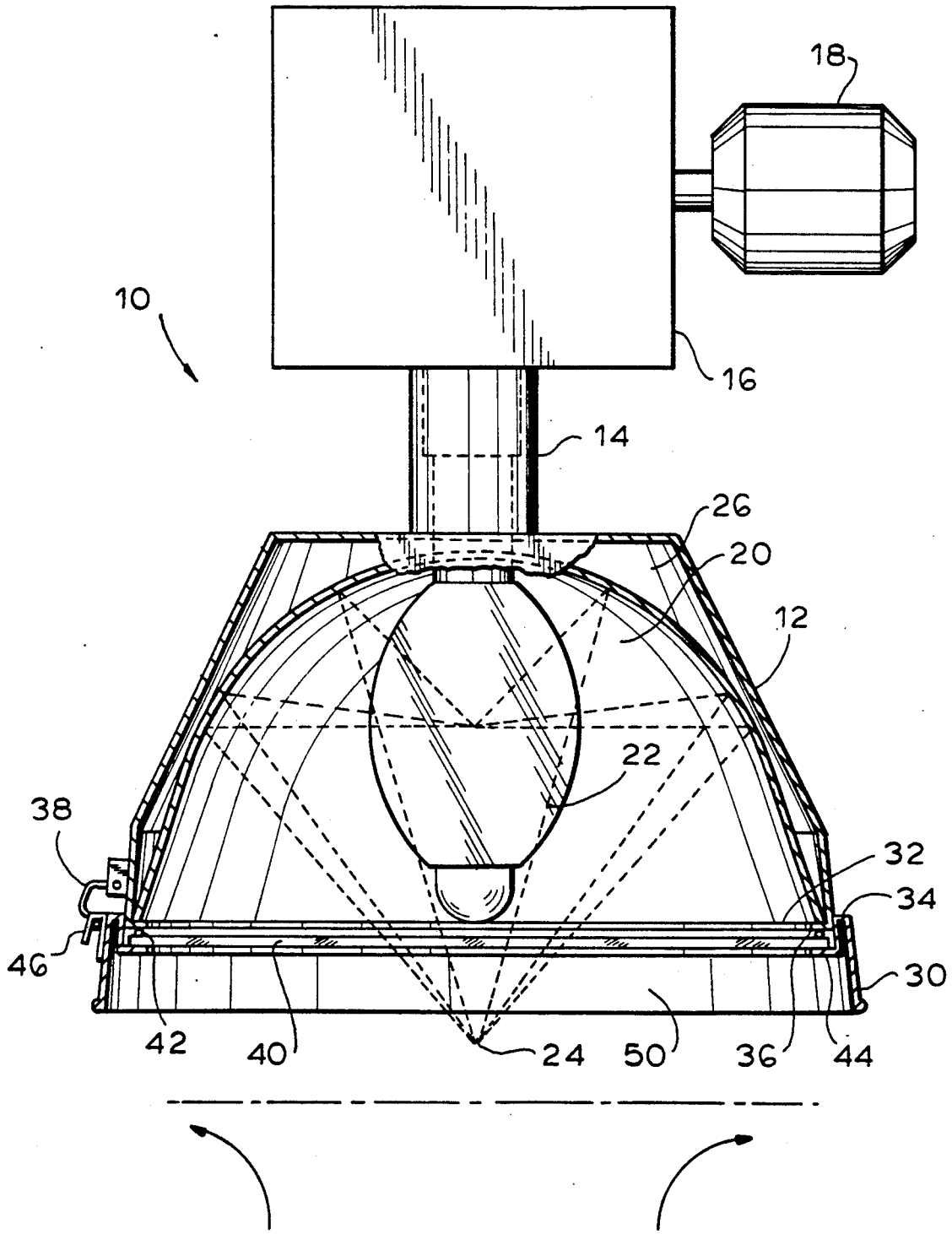

The above, and other objects, features and advantages of this invention will be apparent in the following detailed description of an illustrative embodiment thereof, which is to be read in connection with the accompanying drawings, wherein:

FIG. 1 is a perspective view of a light fixture constructed in accordance with the present invention; and FIG. 2 is an elevational view, partly in section, of the light fixture shown in FIG. 1.

Referring now to the drawing in detail, and initially to FIG. 1 thereof, a light fixture 10 is illustrated which includes an exterior lamp housing or shell 12 formed of aluminum and having a relatively large diameter. Light fixture 10 is intended for use in an industrial environment to produce high intensity light.

Lamp housing 12 is connected by a duct 14 to a utility box 16 which contains the electrical wiring for the lamp. An air filter 18 is connected to utility box 16.

The housing of the light fixture 10 is completely airtight, except for the opening connected to filter 18. As described hereinafter, the base of the housing is sealed by the lens 40. As a result, when the light is on air in the housing will expand under the increased temperature and be forced out of the filter as it expands. While the light is on its housing is cooled by external convection of air flowing around the housing. When the light is turned off the housing cools and so does the air inside of it. As a result air is then drawn through the filter into the housing. Thus, filtered air is permitted to enter and leave the housing to relieve pressure as the air expands and contracts inside it due to heating and cooling of the air from the periodic energizing of the lamp. The air is distributed from the utility box through duct 14 into the housing 12. As thus far described, the lamp is of generally conventional construction and is known in the art.

In accordance with the present invention housing 12 includes an internal reflector 20 (see FIG. 2) which serves to reflect and focus the light from a bulb 22 in the light fixture at a predetermined focal point 24 to produce high intensity light. Bulb 22 may be a halogen bulb, or other form of high intensity light.

In accordance With the present invention, lamp 10 is provided with an extension ring 30 mounted on the lower end of housing 12. As seen more particularly in FIG. 2, the lower end of the housing 12 includes an opening 32 defined by a peripheral edge 34 having an inwardly extending annular flange 36 formed therein. The ring 30 is clamped to the peripheral edge 34 of housing 12 by a plurality of over-the-center clamps or clips 38 of known construction.

In accordance with another feature of the invention, the lower end of the housing 12 is closed with an airtight seal by a lens 40 formed of glass or heat resistant plastic. The lens serves to diffuse light from bulb 22 and also keeps dust from entering the lamp housing and contaminating the reflector or the bulb.

Lens 40 is sealed against the flange 36 of the housing by an annular gasket 42 formed of rubber or the like to aid in preventing dust from entering the housing.

Lens 40 is held in place and clamped against the gasket 42 when the ring 30 is clipped onto housing 12 by clips or clamps 38. More specifically, as seen in FIG. 2, ring 30 includes an inwardly extending annular flange 44 on which the lens 40 will rest. Thus when clips 38 are operated to engage hooks 46 on the outer periphery of ring 30, the ring will be secured to housing 12 and hold lens 40 in a dust sealing relationship against gasket 42.

By this arrangement an air space 50 is formed within the confines of ring 30. As a result, a layer of air is trapped in space 50 by ring 30 and is heated as a result of the high intensity light and heat from bulb 22 which is concentrated by reflector 20. This layer of hot air can not escape from the ring 30 by convection since its upward and lateral movement is blocked. As a result, dust in hot air flowing upwardly towards the light fixture as a result of convection flow in the surrounding air will be deflected away from lens 40 by this hot air layer and dust that does enter this layer will precipitate out because the air is static and will not support airborne particles. Accordingly, the ring 30 operates to form a hot air layer that provides a barrier against the dust and contamination of lens 40 by airborne dust particles is substantially reduced. This then reduces the amount of servicing and cleaning of the lens required during the useful life of the bulb.

Although an illustrative embodiment of the present invention has been described herein with reference to the accompanying drawings, it is to be understood that various changes and modifications can be effected therein by one skilled in the art without departing from the scope or spirit of this invention.

I claim:

1. An electric light fixture comprising a lamp head having an open end, a bulb in said head, an elliptically shaped reflector in said head, said bulb being located at one focus of the elliptical shape of the reflector for focusing light from said bulb at the other focus of the elliptical shape, a transparent lens positioned across said open end of said head between said foci of the elliptical shape closer to the focus at which said light is focused, whereby heat from the lamp is focused and concentrated beneath and near said lens to heat the air adjacent the lens to temperatures sufficient to create a substantial static-air barrier layer adjacent the lens, and an extension ring removably mounted on said open end of said head and extending away from said head and lens thereby to trap the air heated by the focused light adjacent said lens and within the space defined by said ring below said lens whereby dust particles are deflected away from said lens by convection air flow and fall away from said lens when they do manage to get into the layer.

2. The electric light fixture as defined in claim 1 including means for forming an air seal between said lens and said head.

3. An electric light fixture comprising a substantially airtight lamp head having an open end defining a peripheral edge, a light bulb in said head, a reflector mounted in said head and having a generally elliptical shape in cross section said bulb being positioned with the reflector at one of the foci of elliptical shape to focus light from the bulb at the other focal point of the elliptical shape thereby to produce high intensity light and heat in the area of said other focal point, a transparent lens mounted on said head adjacent said peripheral edge to seal said open end, said lens being located between said focal points and adjacent said other focal point whereby heat from the lamp is concentrated beneath and adjacent said lens to heat the air adjacent the lens to temperatures sufficient to create a substantial static-air barrier layer adjacent the lens, means for creating a dust seal between said lens and said head to prevent dust entering into the head, and an extension ring removably mounted on said open end of said head, said ring extending away from said head and said lens thereby to define an air space adjacent said lens containing and trapping said heated static-air barrier layer within said space whereby said static-air barrier layer is formed adjacent the lens to deflect dust particles away from said lens and to cause dust particles entering the layer to fall away from the lens.

4. An electric light fixture as defined in claim 3 wherein said peripheral edge of said lamp head has an inwardly extending flange and said means for creating a dust seal comprises an annular gasket positioned between said flange and said lens.

5. An electric light fixture as defined in claim 4 including a plurality of clip means for releasably clamping said ring to said head.

6. An electric light fixture as defined in claim 5 wherein said ring has an inwardly directed annular flange located to engage and support said lens whereby said clip means clamps said lens and gasket between said flanges.

* * * * *